United States Patent [19]

Cheng

[11] Patent Number: 4,891,620

[45] Date of Patent: Jan. 2, 1990

[54] INSULATING TUBELESS TRANSFORMER

[76] Inventor: Bruce C. H. Cheng, No. 15-2, Lane 324, Sec. 2, Shih Pai Road, Taipei, Taiwan

[21] Appl. No.: 222,926

[22] Filed: Jul. 22, 1988

[51] Int. Cl.[4] ..... H01F 27/30

[52] U.S. Cl. ..... 336/198; 336/208

[58] Field of Search ..... 336/198, 208, 192, 196; 310/194

[56] References Cited

U.S. PATENT DOCUMENTS

| | | | |
|---|---|---|---|
| 3,739,312 | 6/1973 | Knebel | 336/208 X |
| 4,048,606 | 9/1977 | Miller | 336/198 |

FOREIGN PATENT DOCUMENTS

| | | | |
|---|---|---|---|
| 1165918 | 10/1958 | France | 336/198 |
| 653061 | 2/1963 | Italy | 336/198 |
| 157738 | 8/1978 | Netherlands | 336/198 |

*Primary Examiner*—Thomas J. Kozma

*Attorney, Agent, or Firm*—Spencer & Frank

[57] ABSTRACT

An insulating tubeless transformer, by using special winding tubings to achieve the safety requirement and automatic winding without using insulating tubes or other insulation materials, has the advantages of saving material, space reduction and automatic winding.

6 Claims, 2 Drawing Sheets

INSULATING TUBELESS TRANSFORMER

BACKGROUND OF THE INVENTION

The present invention relates to the structure of a transformer, and more specifically to a transformer for use on an alternative power supply, for the purpose of the transmission and amplification of electronic signals. The invention also concerns the effects of electrical insulations.

An alternative power supply as the power source of a computer and its peripheral equipments must conform to electrical safety requirements. There are many international institutions specifying safety inspection standards on electrical items, such as UL, CSA, IEC, etc, and VDE's standards are considered be the most rigorous. The transformer is one of the major items on the list of safety inspections. As far as the safety structure is concerned, a transformer may be divided into a primary winding coil, a secondary winding coil and an iron core, as shown in FIG. 1B. The primary winding is the portion which connects directly with the input power, and has a higher potential; the potential of the second winding is usually lower, and it is a part which people can easily touch. The iron core then comes as a long conductor.

VDE's safety requirement with respect to transformers is summarized as follows:

| | Absolute resistance to pressure | Safe distance |
|---|---|---|
| Between the primary winding and the second winding. | 3 750 VAC for 1 min. | 6 mm min. |
| Between the primary winding and the iron core. | 2 500 VAC for 1 min. | 4 mm min. |
| Between the second winding and the iron core. | 500 VAC for 1 min. | — |

Up to the present, to meet these above-mentioned requirements, in a traditional transformer, as shown in FIG. 1A, it is a common practice to apply an insulating tube 300 on both the beginning end and the closing end of both the primary winding 100 and the second winding 200. In addition, a clearance of a length no less than 3 mm must be maintained on both sides inside the winding coil in relation to the winding tube. Also at least three layers of tape 400 have to be wound between the primary and the second windings. Such a conventional type of transformer, because of the failure to employ automatic sleeving of the insulating tube, 300 requires more time and labor to manufacture, and is impractical for the application of automatic winding.

SUMMARY OF THE INVENTION

In view of the many defects found with conventional transformers disclosed hereinbefore, it is an object of the present invention to provide a newly structured transformer. According to the transformer of the invention, no insulating tube is needed to be applied on either the beginning or the terminating end of either the primary winding or the secondary winding, and no tape is required to be wound between the primary and secondary windings, thereby saving material. Also, the absence of a conventional insulating tube makes possible automatic winding, thereby promoting productivity.

According to the transformer of the invention, the transformer doesn't have to observe a clearance of 3 mm with regard to the interior rim of the winding tube, so that the utility rate of the winding window can be increased, thereby reducing the volume of the iron core, which meets another object of the present invention.

A more complete understanding of these and other features and advantages of the present invention will become apparent from a careful consideration of the following detailed description of an embodiment which is illustrated in the accompanying drawings.

DESCRIPTION OF THE PREFERRED EMBODIMENT

Figure 2:
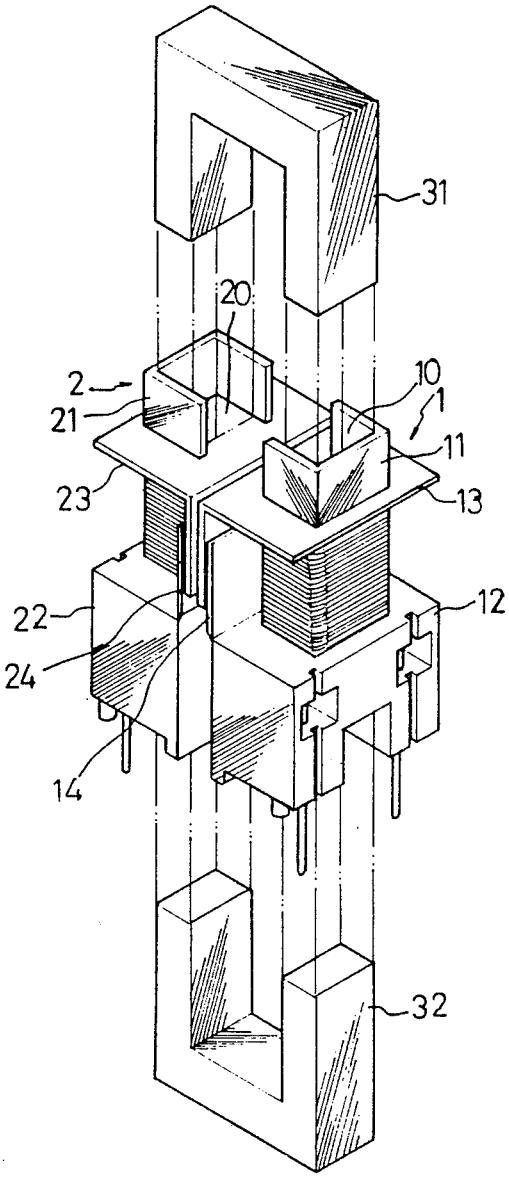
FIG. 2 is a three-dimensional perspective view of the transformer of the invention.
Figure 1A:
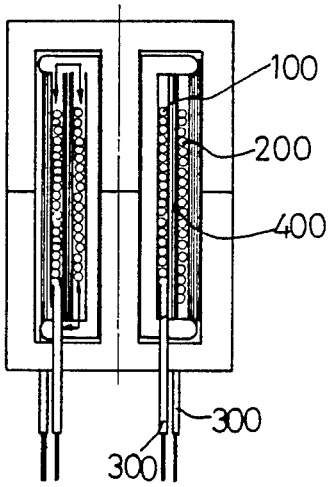
FIG. 1A PRIOR ART
FIG. 1A is a cross-sectional view of a conventional transformer.
Figure 1B:
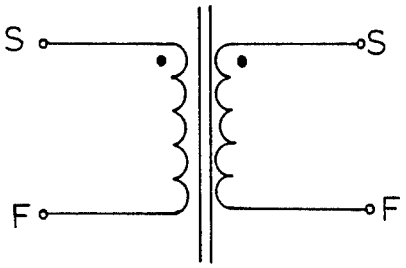
FIG. 1B is an electrical circuit of a transformer.
Figure 3:
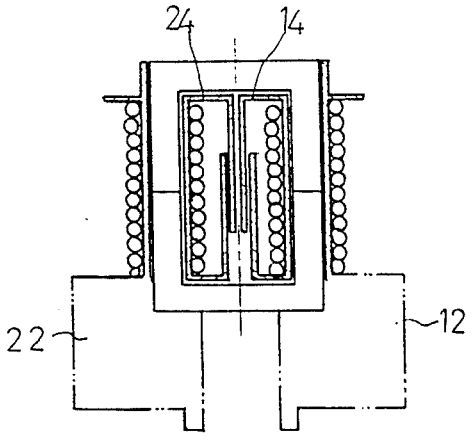
FIG. 3 is a cross-sectional view of the whole embodiment of the invention.
Figure 4:
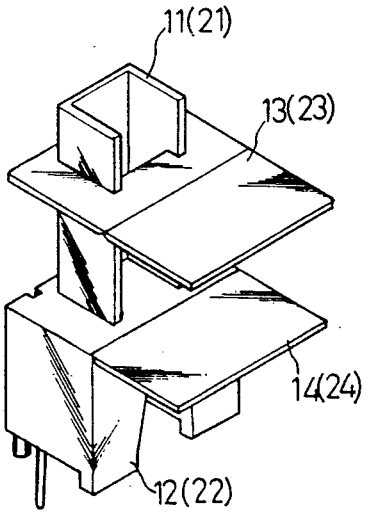
FIG. 4 is an illustration of the winding tubing used in the transformer of the invention.

As shown in FIG. 2 and FIG. 3, the transformer of the invention has two identical winding tubing 1, 2, each comprising essentially a tubing 11, 21 and a seat 12, 22, as shown in FIG. 4. The tubings 11, 21 are each shaped like a clevis, that is, U-shaped in cross section. The tops of the seats 12 and 22 and the tops of the tubings 11 and 21 are respectively provided with externally extending partitions 13, 23 and 14, 24, wherein the partitions 13, 23 at the top section of the respective tubings 11 and 21 extend a small distance toward open mouths thereof. Recesses in the seats 12, 22 are respectively in communication with the interiors 10 and 20 of the tubings 11 and 21. The partitions 13, 14 and 23, 24 are initially all extending in planes perpendicular to the axes of the tubings. Therefore, it is possible to wind the coil over the tubings 11, 21 between the partitions 13, 14, 23, 24 by means of an automatic winder in order to assemble the winding tubing 1, 2. After winding, the partitions 13, 14, 23, 24 are to be folded into the central section of the tubing so as to bring partition 13, 14 respectively close to partition 23, 24. Finally, U-shaped iron cores 31 and 32 are inserted into opposite ends of tubings 11, 21 to obtain the whole embodiment of the transformer of the invention.

The clearance of 6 mm for the interspacing between the primary winding coil and the secondary winding coil of the transformer can be achieved by bending the partitions in the tubings, with the advantage that the partitions 13, 23 on top of the tubings 11, 21 can serve to restrict the position of the upper iron core. Therefore, the nearest distance between the iron cores from the primary and secondary winding coils can be greater than what is required, say, 4 mm. Furthermore, as it is not necessary to maintain a distance of 3 mm on the interior rim during the coil running, which is otherwise necessary in conventional cases, it is achieved to greatly enhance the utility rate of the coil window around the iron core. This serves to reduce the relative volume of the iron core by one third or so, the other material costs can be reduced by up to one third, and the manufacturing time can be reduced by up to 50%. It is therefore of practical use.

Although the present invention has been described with a certain degree of particularity, it is understood that the present disclosure has been made by way of example and that changes in details of structure may be made without departing from the spirit thereof.

I claim:

1. A electrical transformer, comprising:

first and second substantially identical winding support members, said first support member including a first winding tube having a first axis extending in an axial direction and a first seat mounted to said first tube at a first end of said first tube and surrounding a first passageway, said first passageway extending in said axial direction in said first tube and through said first seat;

said second support member including a second winding tube disposed side-by-side with said first tube and having a second axis extending in said axial direction and a second seat mounted to second first tube at a first end of said second tube and surrounding a second passageway, said second passageway extending in said axial direction in said second tube and through said second seat;

first and second flexable and foldable insulating partitions respectively connected to said first winding support member respectively adjacent the first end of said first tube and a second end of said first tube opposite said first end, third and fourth flexable and foldable insulating partitions respectively connected to said second winding support member respectively adjacent the first end of said second tube and a second end of said second tube opposite said first end, a primary wire wound on said first tube about said first axis axially between said first and second partitions;

a secondary wire wound on said second tube about said second axis axially between said third and fourth partitions so as to oppose said primary wire; and an iron core formed of first and second U-shaped core members, said first core member being inserted into said first and second passageways at said first ends, said second core member being inserted into said first and second passageways at said second ends;

said first and second partitions respectively having free ends folded toward each other, and third and fourth partitions having free ends folded toward each other, so that said first, second, third and fourth partitions separate and insulate said primary wire from said secondary wire.

2. An electrical transformer as in claim 1, wherein said first and third partitions respectively surround said first and second tubes adjacent said first ends, and said second and fourth partitions are respectively foldably connected to edges of said first and second seats.

3. An electrical transformer as in claim 2, wherein said first and second tubes are U-shaped in cross section.

4. An electrical transformer as in claim 1, wherein each of said first and second tubes is U-shaped in cross section so as to have three closed sides and one open side.

5. An electrical transformer as in claim 4, wherein said first and third partitions respectively surround said first and second tubes adjacent said first ends and respectively project a short distance radially inward of said first and second tubes at the open side.

6. An electrical transformer as in claim 1 wherein the free ends of the said first and second partitions are overlapping and the free ends of said third and fourth partitions are overlapping.

* * * * *